US012454382B2

(12) United States Patent
Paul

(10) Patent No.: US 12,454,382 B2
(45) Date of Patent: Oct. 28, 2025

(54) PACKAGING MACHINE WITH PUNCH

(71) Applicant: GEA Food Solutions Germany GmbH, Biedenkopf-Wallau (DE)

(72) Inventor: Reiner Paul, Dautphetal-Elmshausen (DE)

(73) Assignee: GEA Food Solutions Germany GmbH, Biedenkopf-Wallau (DE)

( * ) Notice: Subject to any disclaimer, the term of this patent is extended or adjusted under 35 U.S.C. 154(b) by 73 days.

(21) Appl. No.: 18/010,961

(22) PCT Filed: Jun. 10, 2021

(86) PCT No.: PCT/EP2021/065643
§ 371 (c)(1),
(2) Date: Dec. 16, 2022

(87) PCT Pub. No.: WO2021/254877
PCT Pub. Date: Dec. 23, 2021

(65) Prior Publication Data

US 2023/0303285 A1 Sep. 28, 2023

(30) Foreign Application Priority Data

Jun. 19, 2020 (DE) ..... 102020207627.8
Apr. 9, 2021 (DE) ..... 102021203534.5

(51) Int. Cl.
*B65B 9/04* (2006.01)
*B65B 41/12* (2006.01)
(Continued)

(52) U.S. Cl.
CPC ..... *B65B 61/065* (2013.01); *B65B 9/04* (2013.01); *B65B 41/12* (2013.01); *B65B 51/14* (2013.01)

(58) Field of Classification Search
CPC ..... B65B 9/04; B65B 61/065; B65B 61/04
See application file for complete search history.

(56) References Cited

U.S. PATENT DOCUMENTS 3,054,679 A * 9/1962 Bradford ..... B65D 77/2032 206/820
3,238,691 A * 3/1966 Miller ..... B65B 41/18 53/484
(Continued)

FOREIGN PATENT DOCUMENTS

DE 69816763 T2 3/2004
DE 102006049067 A1 4/2008
(Continued)

OTHER PUBLICATIONS

International Search Report and Written Opinion dated Sep. 24, 2021, for International Application PCT/EP2021/065643.
(Continued)

*Primary Examiner* — Praachi M Pathak
(74) *Attorney, Agent, or Firm* — The Dobrusin Law Firm, P.C.

(57) ABSTRACT

A packaging machine and method for producing a packaging with a packaging machine, in which a lower material web is unrolled from a supply roll and transported along the packaging machine and at the same time a material to be packaged is placed on the lower material web and, to complete the packaging, an upper film is sealed to the lower material web in a sealing station, the packaging is cut from the upper and lower material webs, the cutting of the lower material web takes place partially upstream and partially downstream of the sealing station and/or partially upstream and partially in the sealing station.

20 Claims, 2 Drawing Sheets

(51) Int. Cl.
*B65B 51/14* (2006.01)
*B65B 61/06* (2006.01)

(56) References Cited

U.S. PATENT DOCUMENTS 3,503,493 A * 3/1970 Nagy ..... B65D 75/5855 206/532
4,196,809 A * 4/1980 Tonrey ..... B65D 77/2064 206/464
4,372,098 A * 2/1983 Mason ..... B65B 9/045 53/449
4,978,056 A * 12/1990 Ball ..... B65B 61/02 220/359.3
5,277,745 A * 1/1994 Williams ..... B29C 66/91421 156/515
5,311,800 A * 5/1994 Focke ..... B26F 1/384 83/168
5,393,032 A * 2/1995 Cederroth ..... B65D 77/2052 206/532
5,904,263 A * 5/1999 St. Pierre ..... B65D 1/30 220/359.4
7,316,317 B2 * 1/2008 Harper ..... B65D 75/367 206/532
8,615,973 B2 * 12/2013 Mondry ..... B65B 31/028 53/433
9,963,265 B1 * 5/2018 Braverman ..... B65D 21/0206
10,364,055 B2 * 7/2019 Izquierdo ..... B65B 61/065
10,994,891 B2 * 5/2021 Braverman ..... B65D 21/0206
2006/0230708 A1 * 10/2006 Granili ..... B65B 9/045 53/427
2013/0212988 A1 * 8/2013 Schmeiser ..... B65B 9/04 483/1
2017/0190488 A1 * 7/2017 Bates ..... B32B 3/266
2017/0327257 A1 * 11/2017 Sabato ..... B65B 61/06
2018/0016061 A1 * 1/2018 Ferry ..... B65D 25/36
2024/0158113 A1 * 5/2024 Brandt Sanz ..... B65B 61/02

FOREIGN PATENT DOCUMENTS

EP 2484594 A2 * 8/2012 ..... B65B 31/028
EP 2746167 A1 6/2014
WO 2020/058278 A2 3/2020
WO 2020/074411 A1 4/2020

OTHER PUBLICATIONS

International Preliminary Report on Patentability dated Sep. 26, 2022, for International Application PCT/EP2021/065643.

* cited by examiner

PACKAGING MACHINE WITH PUNCH

CROSS-REFERENCE TO RELATED APPLICATIONS

This application is a US National Stage Entry of PCT/EP2021/065643 filed on Jun. 10, 2021, which claims priority to DE 10 2020 207 627.8 filed Jun. 19, 2020 and to DE 10 2021 203 534.5 filed on Apr. 9, 2021, all of which are hereby incorporated by reference herein for all purposes.

FIELD

The present invention relates to a method for producing a packaging with a packaging machine, in which a lower material web is unrolled from a supply roll and transported along the packaging machine and at the same time a material to be packaged is placed on the lower material web and, to produce the packaging, an upper film is sealed to the lower material web in a sealing station. The present invention also relates to a packaging machine for producing a packaging.

BACKGROUND

Packagings with a comparatively complex contour are difficult to cut from the lower material web or, respectively, have a comparatively unclean cut edge or, respectively, the packaging machines required for this are expensive to manufacture or, respectively, comparatively difficult to adjust or, respectively, are comparatively long or, respectively, the service life of the tools required for this is comparatively short or, respectively, a comparatively large number of cutting particles/cutting dust are produced during cutting.

SUMMARY

It was therefore the object of the present invention to provide a method and a packaging machine which do not have the disadvantages of the prior art.

The object is solved with a method for producing a packaging with a packaging machine, in which a lower material web is unrolled from a supply roll and transported along the packaging machine and at the same time a material to be packaged is placed on the lower material web and, to complete the packaging, an upper film is sealed to the lower material web in a sealing station, wherein the completed package is cut from the upper and lower material webs, wherein the cutting of the lower material web takes place partially upstream and partially downstream of the sealing station or partially upstream and partially in the sealing station.

The explanations given with respect to this subject matter of the present invention apply equally to the other subject matter of the present invention and vice versa. Features disclosed with respect to this subject matter of the present invention may be included in the other subject matter.

This subject matter of the present invention relates to a method for producing a packaging, in which a lower material web, for example, a plastic film or a material web having in particular a cardboard, paper or other non-plastic layer, is unrolled from a supply roll and transported preferably intermittently/cyclically along the packaging machine in a transport plane. In a forming station, this lower material web can then first be formed by means of a deep drawing tool, for example, to form a trough and/or a structure, in particular an anti-slip structure, in the lower material web. The forming station usually has a lower tool and an upper tool which are moved towards each other for forming and away from each other for further transport of the lower material web. The lower tool is located below and the upper tool above the transport plane of the lower material web. As a rule, several packagings arranged in a so-called format are processed simultaneously in the packaging machine according to the invention and are subsequently transported simultaneously along the packaging machine. Subsequently, the lower material web is loaded with a material to be packaged, in particular a food product such as sausage, ham or cheese, and in a next step is sealed with an upper film in a sealing station, wherein the upper film is usually sealed to the lower film web. Subsequently, the packaging thus completed is separated by cutting out the packaging from the lower and upper material webs. The upper material web is also unrolled from a supply roll. In relation to the transport direction of the respective film web, downstream of at least one supply roll there is preferably a dancer which keeps the tension in the respective material web at least substantially constant. The dancer can be a linear dancer or a rotational dancer.

The number of packagings produced at the same time and their length or width determine the length of the feed during one cycle, with up to 3 meters being quite common.

Preferably, before sealing, a reduced pressure compared to ambient pressure is generated in the packaging to be produced and/or the atmosphere is changed compared to air, for example, by introducing a gas between the lower material web and the upper film before sealing.

Preferably, the lower material web is transported along the packaging machine by grippers, which are preferably provided equidistantly on a transport means, for example, one, in particular two chains. Each gripper preferably has a lower gripper part and an upper gripper part, wherein the upper gripper part is preferably provided so as to be pivotable relative to the lower gripper part. The lower gripper part can be a separate part or part of the gripper's support.

According to the invention, the carrier of the material to be packaged, for example, the packaging trough on which the material to be packaged is located, is now cut out of the lower material web. According to the invention, this is done in at least two separate steps.

According to one embodiment according to the invention, the cutting of the lower material web takes place partially upstream and partially downstream of the sealing station. The cut downstream of the sealing station is preferably made as a longitudinal cut parallel to the transport direction of the lower material web and the transverse cut is made transverse to the transport direction of the lower material web. In each of these cuts, the lower material web and the upper material web are severed. These cuts preferably sever a different area of the lower material web than the upstream cut.

According to another embodiment according to the invention or a preferred embodiment, the cutting of the lower material web takes place partially upstream and partially in the sealing station. The cut in the sealing station is usually a punch cut that takes place before, after and/or during sealing.

A punch in the sense of the invention severs the lower material web by crushing and/or cutting and/or shear cutting and/or ultrasonic cutting and/or thermal cutting and/or, if applicable, also by means of a relative movement of two cutting means. The punch can have a contour that extends at least partially longitudinally and transversely to the transport direction and can include, in particular, round corner areas. The punch is preferably a contour punch, which preferably has a punching knife with a closed contour. However, the contour of the punching knife can also be reduced by the section already cut upstream.

The following explanations apply to both embodiments according to the invention.

In the upstream cut, only the lower material web is severed, but this is preferably completely severed in the area of this cut.

Preferably, the upstream cutting takes place in the forming station, in particular before and/or while the lower material web is deep drawn, and/or afterwards. Preferably, during the upstream cut, the lower material web is cut only in one, two or more corner area(s) of the carrier of the material to be packaged, while the remaining contour of the carrier of the material to be packaged is cut only in and/or downstream of the sealing station. Preferably, the upstream cut is made at an angle, for example, an angle of 40-50°, in particular 45°, relative to the transport direction of the lower material web. The cut line is preferably straight, but may also be curved or corrugated or kinked or a combination thereof.

The cuts in the lower material web usually result in two or more separate cut-out lower material web elements, for example, the carrier of the material to be packaged and one, two or more corner areas. They are separated from one another by the upstream cut of the lower material web. Consequently, the cut severs the lower material web completely. Each or only some or only one of the lower material web element(s) or only the carrier of the material to be packaged may be bonded with the upper film, for example, by sealing.

The object is further solved with a method for producing a packaging with a packaging machine, in which a lower material web is unrolled from a supply roll and transported along the packaging machine and a packaging trough is formed in the lower material web with a forming tool and a material to be packaged is placed in the packaging trough and an upper film is sealed to the lower material web in a sealing station to complete the packaging, wherein the lower material web is completely severed at least in sections along the contour of the packaging trough before and/or during forming.

The explanations given with respect to this subject matter of the present invention apply equally to the other subject matter of the present invention and vice versa. Features disclosed with respect to this subject matter of the present invention may be included in the other subject matter.

The packaging trough is usually formed by deep drawing, by pulling and/or pressing the lower material web into a lower mold. For this purpose, an upper tool and/or a lower tool are moved towards each other, preferably along the perpendicular, until they contact, preferably clamp, the lower material web on both surfaces, in particular horizontal surfaces. Preferably during this movement, the cutting of the lower material web takes place in a section of the contour, for example, in one or more corner areas. In these sections, the lower material web is preferably severed completely. Thus, cutting takes place preferably even before forming of the lower material web.

Preferably, the complete cutting out of the packaging from the lower material web takes place in and/or downstream of the sealing station. After this, there is preferably no cut area in the lower material web in which the lower material web is not completely severed.

It is particularly preferred that no non-separated cut area remains, in particular that no non-separated cut area remains at the transitions to the corner area(s) already cut upstream of the sealing station, for example, because uncut transitions can hinder the opening of the packaging at a later time.

Preferably, the upper film is severed for separation in and/or downstream of the sealing station.

Preferably, the contour of the upper material web and the contour of the lower material web are different in the completed packaging. In particular, the contour of the upper material web is larger than that of the lower material web.

Furthermore, the object is solved with a packaging machine which unrolls a lower material web from a supply roll and transports it intermittently or continuously along the packaging machine and which is being loaded with a material to be packaged, wherein, for completion of a packaging, an upper material web is subsequently sealed to the lower material web in a sealing station, wherein a punch is provided which severs the lower material web along at least one partial area of the contour of a packaging to be produced, wherein the punch is provided in the forming tool. The person skilled in the art understands that the forming tool can also be a tool without deep drawing.

The explanations given with respect to this subject matter of the present invention apply equally to the other subject matter of the present invention and vice versa. Features disclosed with respect to this subject matter of the present invention may be included in the other subject matter.

This subject matter of the present invention relates to a packaging machine, in particular a so-called thermoformer, for producing a packaging, in which a lower material web, for example, a plastic film or a material web having in particular a cardboard, paper or other non-plastic layer, is unrolled from a supply roll and transported preferably intermittently/cyclically along the packaging machine in a transport plane. In a forming station, this lower material web is then first formed by means of a deep drawing tool or remains unformed, for example, to form a trough and/or a structure, in particular an anti-slip structure, in the lower material web. The forming station usually has a lower tool and an upper tool which are moved towards each other for forming and away from each other for further transport of the lower material web. The lower tool is located below and the upper tool above the transport plane of the lower material web. As a rule, several packagings arranged in a so-called format are processed simultaneously in the packaging machine according to the invention and are subsequently transported simultaneously along the packaging machine. Subsequently, the lower material web is loaded with a material to be packaged, in particular a food product such as sausage, ham or cheese, and in a next step is sealed with an upper film in a sealing station, wherein the upper film is usually sealed to the lower film web. Subsequently, the packaging thus completed is separated by completely cutting out the packaging from the lower and upper material webs. The upper material web is also unrolled from a supply roll. In relation to the transport direction of the respective film web, downstream of at least one supply roll there is preferably a dancer which keeps the tension in the respective material web at least substantially constant. The dancer can be a linear dancer or a rotational dancer.

According to the invention, at least one punch is provided in the forming station for each packaging to be produced, which punch severs the lower material web, in particular along a partial area of the contour of the packaging trough, wherein the trough remains unformed or is to be formed and/or has already been formed. The remaining contour of the packaging trough is not severed. In the case of a format of several packaging troughs, preferably at least one separate punch is provided for each packaging trough, the cutting behavior of which can preferably be individually adjusted in each case, in particular to the local conditions of the respective packaging in the format.

The punch in the forming station has proven to be advantageous because an additional cutting station can be omitted, including the protective devices and safety lengths to be taken into account that would otherwise be required for this and including, if applicable, the drive, so that the packaging machine can be designed to be shorter and less complex.

Preferably, each punch of the format has a knife and a counter knife. The knife preferably has a horizontal cutting edge. The counter knife is preferably a plate or plate-like body against which the knife presses during punching.

There can also be several punches provided per format. Preferably, the number of punches corresponds to the number of packaging of one format to be produced.

According to another inventive or preferred subject matter of the present invention, the knife of the punch is provided on a lower tool of the forming station and the counter knife is provided on an upper tool of the forming station or vice versa.

The explanations given with respect to this subject matter of the present invention apply equally to the other subject matter of the present invention and vice versa. Features disclosed with respect to this subject matter of the present invention may be included in the other subject matter.

Preferably, the lower tool and upper tool have a clamping plane. Preferably, the clamping plane is the transport plane of the lower material web. In this clamping plane, at least one tool rests against the lower material web during and/or after the moving together of the two tools. Preferably, however, both tools rest against the material web and clamp it between the two tools. The knife may protrude from this clamping plane so that it cuts the lower material web when the two tools are moved together. The extent to which the knife protrudes from the clamping plane is preferably individually adjustable, preferably during operation of the packaging machine, in particular by motor and especially preferred automatically. Preferably, the knife is stationary relative to the tool on which it is mounted.

However, it can also be provided that the knife is only moved, for example, pushed, into the clamping plane and/or beyond it during and/or upon and/or after completion of the moving together of the two tools, for example, from a protected waiting position, for example, so that the material web is clamped or at least held on one side by the knife preferably before it is severed, for example, to reduce or avoid wrinkles and/or to improve the cut quality on the lower material web, and/or to avoid or at least reduce the risk of accidents as a result of contact with the cutting edge when the tool is open, for example, during maintenance work.

Likewise, it can be advantageous if the knife and/or counter knife is moved back out of the clamping plane, for example, into its protected waiting position, after the cutting process has been completed and/or before the tool is opened. The retracting movement of the knife and/or counter knife prior to the two tools starting to move apart can have the advantage of stripping the partially separated material web from the knife and/or not unintentionally lifting the lower material web as a result of the frictional force, and/or while the two tools are moving apart for example, to reduce the total time required for these work steps.

Preferably, the counter knife is elastically and/or longitudinally displaceably mounted on a tool of the forming station. The elasticity of the mounting of the counter knife is preferably provided in such a way that a sufficient punching pressure is generated when the knife comes into contact. Preferably, the counterpressure increases with the longitudinal displacement of the counter knife during the punching process. Preferably, the position of the counter knife relative to the tool on which it is mounted is provided to be individually adjustable for each counter knife, preferably provided to be coarsely and finely adjustable, for example, by means of an adjustment means, for example, an adjustment screw and/or one or a combination of shims, which preferably have different thicknesses, preferably <0.5 mm thickness, more preferably <0.3 mm thickness, particularly preferably <=0.1 mm thickness.

Preferably, both the counter knife and the knife are provided to be adjustable, but particularly preferably, only one of the two knives is provided to be adjustable.

The elastic mounting of the counter knife is preferably provided with one or a combination of elastic supports, for example elastic supports made of silicone, which for example have a Shore hardness A of <90, preferably <70, particularly preferably <=50. The thickness of such a support is, for example, 3 mm or 5 mm. Alternatively or additionally, the knife that acts on the counter knife is elastically mounted.

Preferably, the elastic mounting and longitudinal displacement of the knife and/or counter knife is realized by means of a spring mounting of the knife and/or counter knife.

It has proved to be particularly advantageous that due to the elasticity of the mounting, the cutting force of the counter knife and/or knife practically adjusts itself within the set limits during the cut and unwanted load peaks are reliably avoided or at least considerably reduced, which noticeably extends the service life of at least the knife and counter knife.

It has also been shown to be advantageous that the punching according to the invention counteracts the formation of cutting dust, in particular when cutting fiber-containing material web, for example, paper, cardboard or corrugated board, and/or that the cut edge becomes particularly clean, for example, frays/roves noticeably less and/or shows virtually no material throw-ups, and thus offers a very good overall optical appearance.

It has also proved advantageous that due to the elasticity of the, preferably individual, mounting of knives and/or counter knives, the adjusting of several simultaneously acting knives is considerably simplified, for example, in order to realize the simultaneous partial cutting on several packaging troughs within one format, for example, on a format consisting of 4×4 packaging troughs with preferably at least 16 knives.

Alternatively, a plurality of knives and/or counter knives is arranged on a common support, for example, a common plate, which is elastically mounted. Furthermore, it has proven advantageous that the degree of elasticity and/or longitudinal displacement of the mounting of the counter knife and/or knife according to the invention can be changed, in particular adjusted and/or readjusted, during operation, for example, by varying a pneumatic and/or hydraulic cushion and/or an adjusting screw.

Preferably, a seal is provided on at least one tool in the area of the punch. Preferably, the seal extends into the clamping plane. Preferably, the seal is provided as a closed form, for example, as a ring. For example, the seal serves to separate fluids that support forming, for example, sub-vacuum and/or forming air and/or the seal prevents or reduces the tendency of the lower material web to tear as a result of material stresses in the area of the punch cuts and/or the seal supports the clamping of the lower material web.

According to a further inventive or preferred subject matter of the present invention, a dust extraction or dust blowing device is provided on the tool, preferably the lower tool of the forming station, on which the partial cutting of the lower material web takes place upstream of the sealing station, for example, in order to remove dust generated during the partial cutting of the lower material web and/or preferably during the cutting of the lateral holes, at least to the greatest possible extent.

The explanations given with respect to this subject matter of the present invention apply equally to the other subject matter of the present invention and vice versa. Features disclosed with respect to this subject matter of the present invention may be included in the other subject matter.

For example, the removal of particles is done by blowing air through one or more holes, but preferably by extracting air, in particular when the tool is open, for example, before forming the lower material web, especially during the feeding.

Another subject matter of the present invention is a method of operating the packaging machine according to the invention, in particular the packaging machine according to the invention, in which the knife is only moved, in particular pushed, out of a waiting position into the clamping plane during the moving together and/or during and/or after completion of the moving together of the two tools.

The explanations given with respect to this subject matter of the present invention apply equally to the other subject matter of the present invention and vice versa. Features disclosed with respect to this subject matter of the present invention may be included in the other subject matter.

Still another subject matter of the present invention is a method of operating a packaging machine, in particular the packaging machine according to the invention, in which the knife is moved back into its protected waiting position after the cutting process has been completed, before and/or while the two tools move apart.

The explanations given with respect to this subject matter of the present invention apply equally to the other subject matter of the present invention and vice versa. Features disclosed with respect to this subject matter of the present invention may be included in the other subject matter.

BRIEF DESCRIPTION OF THE DRAWINGS

The inventions are explained below with reference to FIGS. 1 to 4. These explanations are merely exemplary and do not limit the general idea of the invention. The explanations apply equally to all subject matter of the present invention.

DETAILED DESCRIPTION

Figure 1:
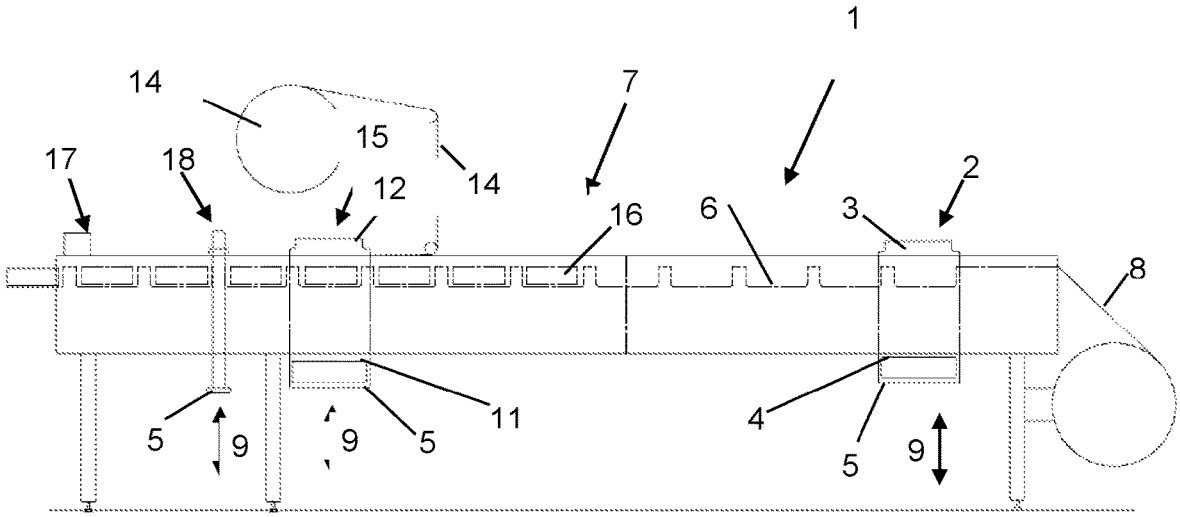
FIG. 1 shows the packaging machine according to the invention.

FIG. 1 shows the packaging machine 1 according to the invention, which optionally has a forming station 2, a filling station 7 and a sealing station 15. A lower material web 8, in this case a plastic film 8, is pulled off a supply roll 22 and transported from right to left in cycles along the packaging machine according to the invention. In each cycle, the bottom web 8 is advanced by one format length/feed length. For this purpose, the packaging machine has two transport means (not shown), in the present case respectively two endless chains, which are arranged to the right and left of the lower material web 8. Both at the beginning and at the end of the packaging machine, respectively at least one gear is provided for each chain, around which the respective chain is redirected. At least one of these gears is driven. The gears in the inlet section and/or in the outlet section can be connected to each other, preferably by a rigid shaft. Each transport means has a plurality of clamping means/grippers which grip the lower material web 8 in a clamping manner in the infeed area 19 and transfer the movement of the transport means to the lower material web 8. In the outfeed area of the packaging machine, the clamping connection between the transport means and the lower material web 8 is released again. Downstream of the inlet section 19, heating means can be provided to heat the lower material web 8, especially when it is standing still. The forming station 2 has a lower tool 4 and an upper tool 3. The lower tool 4 can be moved up and down as indicated by the double arrow, wherein it is moved upward toward the lower material web 8 for forming and downward for further transport of the lower material web 8. In the raised position, the lower material web is preferably clamped between the two tools 3, 4. Punching means 10, which are explained in more detail with reference to FIGS. 3 and 4, can be provided on at least one of the two tools 3, 4. The lower tool 4 can be located on a lifting table 5, which, as symbolized by the double arrow, can be vertically adjustable to produce the lower tool movement described above. As this happens, the punch 10 or its knife 25 is moved along. In the further course of the packaging machine, the packaging troughs 6 formed in the lower material web as indicated here or the lower material web 8 are then loaded with the material to be packaged 16 in the filling station 7. In the sealing station 15 following downstream therefrom, which also consists of an upper tool 12 and a, if applicable, vertically adjustable lower tool 11, an upper film 14 is attached to the lower material web 8 in a material-bonding manner by sealing. Thereby, the movement of the lower material web 8 is transferred to the upper material web 14. In the sealing station, too, the upper tool and/or optionally the lower tool are lowered or raised before and after each film transport. The upper film 14 can also be guided in transport means or transported by transport chains, wherein these transport means then only extend before the sealing station and, if applicable, upstream. Otherwise, the explanations given for the transport means of the bottom film apply. The upper film can also be heated and/or deep drawn with heating means. For sealing, the lower tool 11 is provided, for example, as a heatable sealing frame which has an opening for each packaging trough into which the, if applicable, present packaging trough dips during sealing, i.e. during the upward movement of the lower sealing tool. For sealing, the upper and lower material webs are pressed together between the upper and lower tools 12, 11 and bond under the influence of heat and pressure. After sealing, the tools 11, 12 are moved apart again vertically. A dancer, for example, a rotary dancer, which keeps the film web 14 at a constant tension to the extent possible, can be provided between the supply roll of the upper material web 14 and the sealing tool. The person skilled in the art understands that a dancer is also preferably provided in the area of the lower material web 8, preferably downstream of the supply roll. Preferably, the dancer is a linear dancer. A gas exchange preferably takes place in each packaging trough before and/or during the sealing of the upper material web to the lower material web. For this purpose, the air present in the packaging trough is first partially extracted and/or replaced by an exchange gas. For this purpose, holes can be made in the area of each format in the lower material web 8 in the area of the transport chains, through which holes the air between the material webs 8, 14 is extracted and/or the exchange gas is blown in. However, these holes are different from the contour cut explained with reference to FIG. 2. In the further course of the packaging machine, the completed packagings are separated, which, according to one embodiment of the method according to the invention, is done with the transverse cutter 18 and the longitudinal cutter 17. In the present case, the transverse cutter 18 can also be raised or lowered by means of a lifting device 9. Preferably, each cycle produces several packagings simultaneously, arranged as matrix in a so-called format. According to another embodiment of the method according to the invention, the sealing tool 11, 12 has a punch which severs the lower and upper material webs before, during and/or after sealing.

According to the invention, the lower material web 8 is punched/cut in at least two different places along the contour of the carrier of the material to be packaged, for example, in the forming station and downstream of the sealing station or in the forming station and in the sealing station. The contour cut of the upper material web 14, on the other hand, only takes place in the sealing station or downstream of it.

Figure 2:
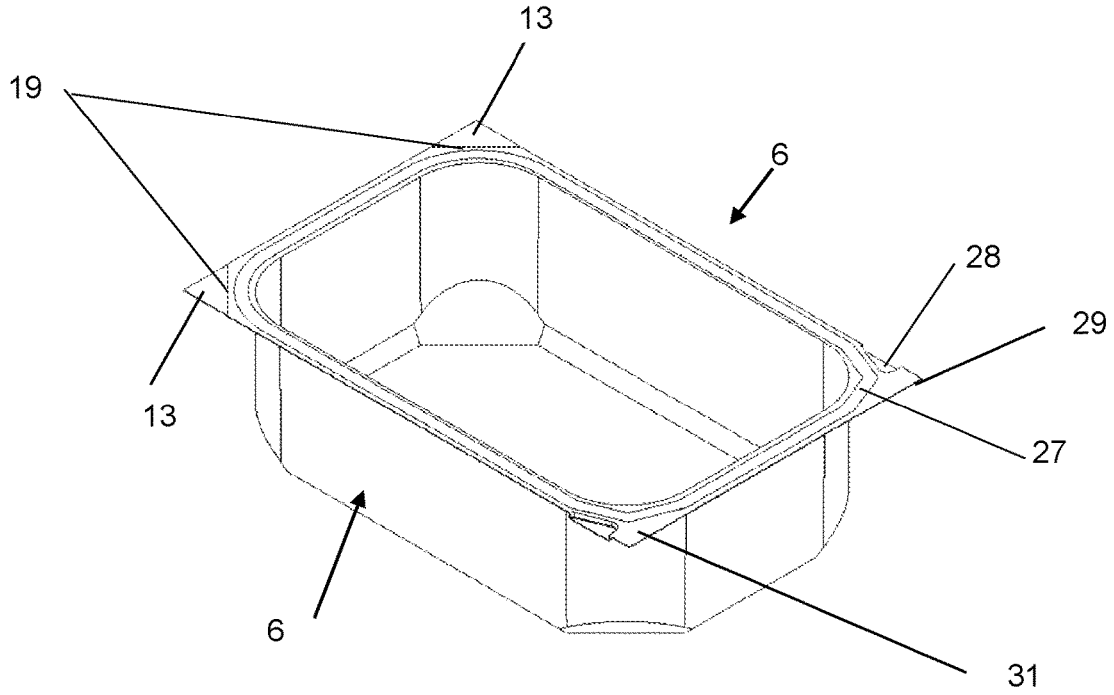
FIG. 2 shows an example of the packaging to be produced.

FIG. 2 shows a packaging that can be produced with the method according to the invention or, respectively, with the packaging machine according to the invention. The packaging has a packaging trough which has been formed, in particular deep drawn, from the lower material web 8. Here, the packaging trough has a horizontal flange 31 to which an upper material web 14 is sealed along a sealing seam 27. The packaging may optionally have opening aids 28 to facilitate releasing the upper material web from the packaging trough. For separation, the finished packaging is cut along its contour 29 out of a format from the lower and upper material webs. Reference number 19 indicates one, in this case two, contour cut(s) provided only in the lower material web, but preferably severing it completely along the cut. The contour cut 19 is provided here in the corner area of the packaging trough 6. The contour cut 19 is provided upstream of the sealing station, particularly in the forming station. Complete separation of the packaging, on the other hand, takes place either in the sealing station or downstream of the sealing station by separating the packaging along its contour from the lower and upper material webs. In the present case, this is done by four straight cuts, two longitudinal and two transverse cuts, or one contour cut. After separation, at least two, in this case three, separate parts are produced for each packaging from the bottom web material 8, in this case the packaging trough 6 and two corner parts 13. The corner parts can be disposed of as waste or bonded to the top web material 14. In the first case, the top web material protrudes beyond the corner area of the packaging trough 6 and can thus be easily grasped with two fingers for opening the packaging. In the second case, the cut-off area 13 is bonded to the upper material and provides additional grip for opening the packaging. Because the cut 19 already takes place upstream of the sealing station, the separation of the packaging can be made by simple straight cuts and the contour of the packaging trough and the contour of the upper material web of a packaging can be different. In particular, the contour of the upper material web can be larger than the contour of the packaging trough, providing engagement surfaces for easier opening of the packaging.

A gassing or degassing opening in the lower material web 8, which serves to change the atmosphere in the resulting packaging, is not a contour cut 19 in the sense of the present invention.

Figure 3:
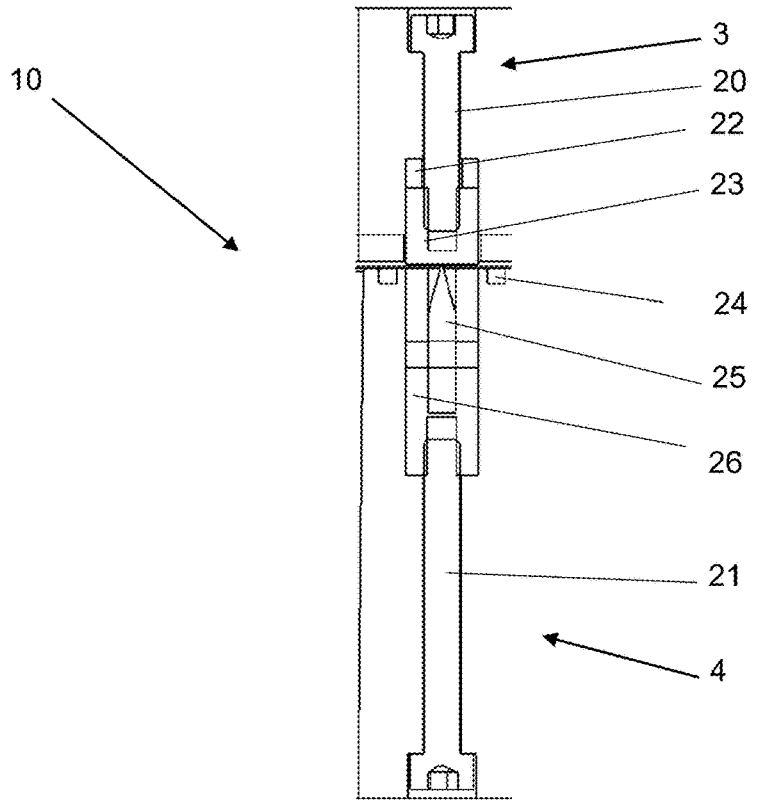
FIGS. 3 and 4 show the punch
Figure 4:
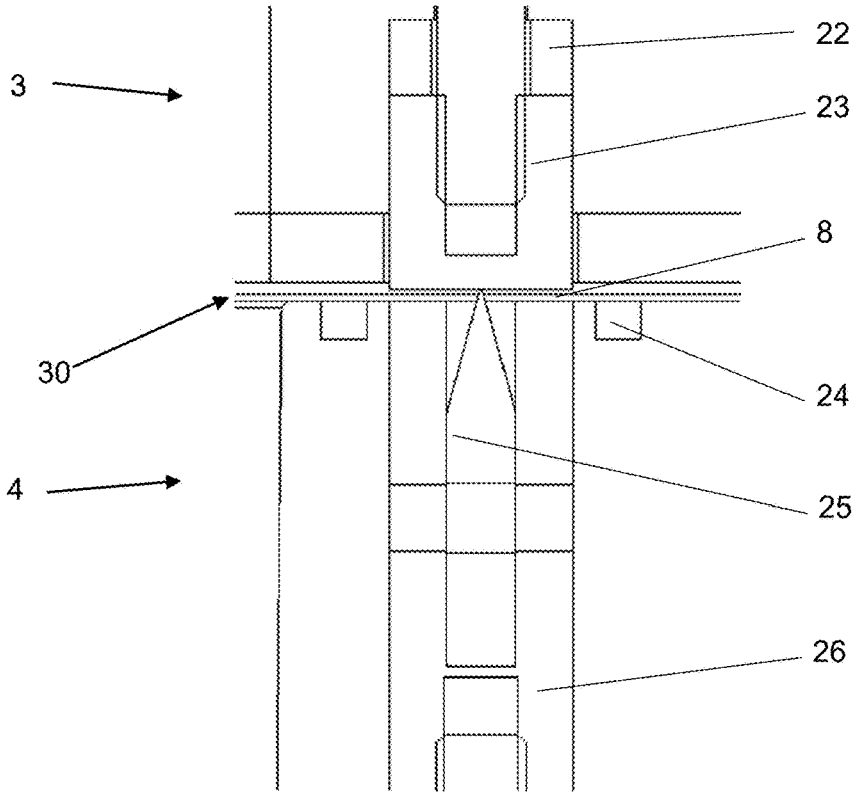

FIGS. 3 and 4 show the punching means 10, which consist of a knife 25 and a counter knife 23, in this case a counter plate. The knife 25 and the counter plate 23 interact in a cutting and/or squeezing manner and thereby sever the lower material web 8. In the present case, the knife 25 is connected to the lower tool 4 of the forming station and the counter knife 23 is connected to the upper tool 3 of the forming station. When producing a format consisting of several packagings, at least one punch 10 is provided for each packaging to be produced. The knife 25 or the counter knife 23 can be interchangeably connected to the respective tool 3, 4, here by means of the screws 20, 21. The knife 25 is driven by the vertical movement of the tool 4. The position of the knife 25 and/or the counter knife 23 with respect to the clamping plane is preferably adjustable, in particular individually adjustable for each packaging to be produced. For this purpose, the knife 25 preferably has a knife holder 26. The counter knife is displaceably mounted on the tool 3, in particular vertically displaceably. The vertical displacement takes place in particular by the knife 25 during and/or after the material web 8 has been severed. In order to build up a certain cutting pressure before or during cutting, the counter knife, on the side opposite the knife, has spring means 22, for example, an elastic plate, in particular a silicone or rubber plate, which compresses elastically during the vertical movement of the counter knife. Alternatively, the spring means 22 are designed as a gas cushion or oil cushion, for example.

In the area of the clamping plane 30, here on the lower tool 3, which serves as a mold for forming the packaging troughs, a seal 24 is provided, which preferably extends around the entire circumference of each punch 10. Preferably, the seal is elastically compressed when the two tools 3, 4 are moved together. The seal 24 facilitates the vacuum build-up in the tool 3 for forming, in this case deep drawing, the packaging trough 6 and, if applicable, supports the clamping of the film.

REFERENCE SYMBOL LIST

1 Packaging machine
2 Forming station, deep drawing station
3 Upper tool of the forming station, upper tool of the deep drawing station
4 Lower tool of the forming station, upper tool of the deep drawing station
5 Lifting table, carrier of a tool of the sealing station, deep drawing station and/or cutting device
6 Carrier of the material to be packaged, packaging trough, lower tray, tray
7 Filling station, inserting station
8 Material web, lower material web
9 Lifting device
10 Punching means
11 Lower tool of the sealing station
12 Upper tool of the sealing station
13 Separated section, corner
14 Upper material web, cover material web
15 Sealing station
16 Material to be packaged
17 Longitudinal cutter
18 Transverse cutter

19 Contour cut, partial contour cut, preferably by means of the punch 10
20 Fastening, screw, adjusting screw, adjusting means
21 Fastening, screw, adjusting screw, adjusting means
22 Spring means, elastic plate, silicone cushion, elastic adjusting means
23 Counter knife, counter plate
24 Seal
25 Knife
26 Holder for cutting line, knife holder
27 Sealing seam, sealing seam area
28 Opening aid, for example, peel corner
29 Contour of the packaging
30 Clamping plane
31 Flange

The invention claimed is:

1. A method for producing a packaging with a packaging machine, the method comprising:
unrolling a lower material web from a supply roll;
transporting the lower material web along a transport direction of the packaging machine;
forming a packaging trough into the lower material web with a forming tool in a forming station to include a base and a horizontal flame that extends horizontally from the base;
placing a material to be packaged in the packeting trough;
sealing an upper film to the horizontal flame of the packaging trough in a sealing station;
wherein before and/or during the forming step in which the packaging trough is formed in the lower material web, the method comprises completely severing one or more sections of the lower material web resulting in one or more corner areas of the horizontal flame being completely several from the horizontal flange.

2. The method according to claim 1, wherein the method comprises severing the upper film in and/or downstream of the sealing station.

3. The method according to claim 2, wherein after the step of completely severing the one or more sections of the lower material web, and after the step of sealing the upper film to the horizontal flange, the upper film protrudes beyond the horizontal flange in a region where the one or more corner areas of the horizontal flange have been completely severed.

4. The method according to claim 3, wherein the one or more sections of the lower material web that have been completely severed is/are cut at an angle of 40 degrees to 50 degrees relative to the transport direction of the lower material web.

5. The method according to claim 1, wherein the method comprises forming one or more opening aids at a top surface of the horizontal flange of the packaging trough to facilitate releasing the upper film from the packaging trough.

6. The method according to claim 5, wherein the one or more opening aids comprise one or more recessed areas in the top surface of the horizontal flange, the one or more recessed areas are defined in a horizontal plane that is lower than a horizontal plane that includes the top surface of the horizontal flange.

7. The method according to claim 6, wherein the horizontal flange comprises two corner areas that have been completely severed, the two corner areas that have been completely severed are located at one side of the horizontal flange; and the one or more opening aids are located at an opposite side of the horizontal flange.

8. The method according to claim 1, wherein the packaging machine comprises a punch that completely severs the one or more sections of the lower material web before and/or during the forming of the packaging trough, wherein the punch comprises a knife and a counter knife, and the lower material web is provided between the knife and the counter knife.

9. The method according to claim 8, wherein the counter knife comprises a biasing device that is compressed during vertical movement of the counter knife.

10. The method according to claim 1, wherein the one or more sections of the lower material web that is/are completely severed is/are disposed of as waste or is/are bonded to the upper film.

11. The method according to claim 1, wherein the horizontal flange comprises two adjacent sides that are arranged in an orthogonal relationship, wherein a straight edge extends between the two adjacent sides.

12. The method according to claim 1, wherein the horizontal flange comprises a straight edge where the one or more sections been completely severed from the lower material web.

13. A method for producing a packaging with a packaging machine, in which a lower material web is unrolled from a supply roll and transported along the packaging machine the method comprises forming a packaging trough in the lower material web with a forming tool, placing a material to be packaged in the packaging trough, and sealing an upper film to the lower material web in a sealing station to complete the packaging, wherein the packaging trough comprises a flange to which the upper film is sealed in the sealing station, wherein the flange comprises a corner area where a section of the lower material web is completely cut from the flange before and/or during the forming of the packaging trough resulting in the flange having a straight edge in the corner area remaining where the section of the lower material web was completely cut, and wherein the method comprises forming one or more opening aids on the flange of the packing trough to facilitate releasing the upper film from the packaging trough, wherein the one or more opening aids comprise a depression formed in a top surface of the flange that is a low spot relative to a remainder of the top surface of the flange.

14. The method according to claim 13, wherein the section of the lower material web that has been completely cut from the flange is cut at an angle of 40 degrees to 50 degrees relative to a transport direction of the lower material web.

15. The method according to claim 13, wherein after the section of the lower material web is completely cut from the flange, and after the upper film is sealed to the lower material web, the upper film protrudes beyond the flange in the corner area of the flange.

16. The method according to claim 13, wherein the upper film is cut in a step after the section of the lower material web has been completely cut from the flange.

17. The method according to claim 13, wherein the packaging machine comprises a punch that completely cuts the section of the lower material web before and/or during forming of the packaging trough, wherein the punch comprises a knife and a counter knife and the lower material web is provided between the knife and the counter knife.

18. The method according to claim 17, wherein the counter knife comprises a biasing device that is compressed during vertical movement of the counter knife.

19. The method according to claim 13, wherein the section of the lower material web that has been completely cut from the flange before and/or during the forming is disposed of as waste or is bonded to the upper film.

20. The method according to claim 13, wherein the flange comprises two adjacent sides that are arranged in an orthogonal relationship, wherein the straight edge extends between the two adjacent sides of the flange.

* * * * *